US009663732B2

(12) United States Patent
Ganyu

(10) Patent No.: US 9,663,732 B2
(45) Date of Patent: May 30, 2017

(54) PROCESS FOR CONTROLLING OPERATIONS OF A RESIDUE PROCESS UNIT

(71) Applicant: UOP LLC, Des Plaines, IL (US)

(72) Inventor: Brian Ganyu, Gurnee, IL (US)

(73) Assignee: UOP LLC, Des Paines, IL (US)

( * ) Notice: Subject to any disclaimer, the term of this patent is extended or adjusted under 35 U.S.C. 154(b) by 212 days.

(21) Appl. No.: 14/481,482

(22) Filed: Sep. 9, 2014

(65) Prior Publication Data

US 2016/0068768 A1 Mar. 10, 2016

(51) Int. Cl.

| | |
|---|---|
| ***C10G 21/30*** | (2006.01) |
| ***C10G 67/04*** | (2006.01) |
| ***C10G 21/14*** | (2006.01) |

(52) U.S. Cl.

CPC ..... *C10G 67/049* (2013.01); *C10G 21/14* (2013.01); *C10G 21/30* (2013.01); *C10G 67/0463* (2013.01)

(58) Field of Classification Search

CPC C10G 21/30; C10G 67/0454; C10G 67/0463; C10G 67/0472; C10G 67/0481; C10G 67/049

See application file for complete search history.

(56) References Cited

U.S. PATENT DOCUMENTS

| | | | | |
|---|---|---|---|---|
| 5,076,909 | A * | 12/1991 | Overfield | C10G 11/187 208/177 |
| 6,533,925 | B1 | 3/2003 | Wallace et al. | |
| 7,279,090 | B2 | 10/2007 | Colyar et al. | |
| 8,110,090 | B2 | 2/2012 | Zimmerman et al. | |
| 8,193,401 | B2 | 6/2012 | McGehee et al. | |
| 8,287,720 | B2 | 10/2012 | Baldassari et al. | |
| 8,343,334 | B2 | 1/2013 | Koseoglu | |
| 8,372,266 | B2 | 2/2013 | Biswas et al. | |
| 8,574,425 | B2 | 11/2013 | Hoehn et al. | |
| 8,636,896 | B2 | 1/2014 | Gueret et al. | |
| 2010/0320122 | A1 | 12/2010 | Baldassari et al. | |
| 2010/0326883 | A1 | 12/2010 | Van Wees et al. | |
| 2011/0139681 | A1 | 6/2011 | McGehee et al. | |
| 2011/0142729 | A1 | 6/2011 | McGehee et al. | |
| 2013/0112593 | A1 | 5/2013 | Montanari et al. | |
| 2013/0180888 | A1 | 7/2013 | Corscadden et al. | |
| 2013/0206642 | A1 | 8/2013 | Zhao et al. | |
| 2013/0240407 | A1 | 9/2013 | Gillis | |

(Continued)

FOREIGN PATENT DOCUMENTS

| | | |
|---|---|---|
| CN | 101418222 B | 9/2012 |

OTHER PUBLICATIONS

Raia, J.C. et al. (2000). Journal of Chromatographic Science, 38,1-5.*

(Continued)

*Primary Examiner* — Brian McCaig

(57) ABSTRACT

One exemplary embodiment can be a process for controlling operations of a residue process unit. The process may include analyzing an overhead stream from an extraction column in a solvent deasphalting zone to determine a density of the overhead stream, and adjusting conditions of the extraction column in response to the density determined for the overhead stream depending on the operating constraints of one or more downstream hydroprocessing zones.

20 Claims, 1 Drawing Sheet

(56) References Cited

U.S. PATENT DOCUMENTS

2013/0319910 A1 12/2013 Koseoglu et al.

OTHER PUBLICATIONS

Speight, J.G. (2009). Enhanced Recovery Methods for Heavy Oil and Tar Sands, Gulf Publishing, 354 pgs [Office action cites p. 78].*
Low, J.Y. et al. (1995). "Variable Products from the Bottom of the Barrel Using ROSE® Technology" in Symposium of Petroleum Chemistry and Processing, 210th National Meeting, American Chemical Society, Aug. 20-25, pp. 780-784.*
Wiehe, I.A. (2008). Process Chemistry of Petroleum Macromolecules, CRC Press, 427 pgs [Office action cites pp. 331-335].*
Baldassari et al., "LC-MAX and Other LC-Fining Process Enhancements to Extend Conversion and On-stream Factor", AFPM Annual Meeting 2012, 21st International Specialty Conference on Cold-Formed Steel Structures, Mar. 2012, pp. 504-519.
De Haan et al., "New Residue-Upgrading Complex Achieves Euro 5 Specifications", Hydrocarbon Processing, Feb. 2, 2013, vol. 92, No. 2, p. 6 pages.
Faupel et al, "Debottleneck Refinery Operations by Integrating the H-Oil Process With a Deasphalter", AIChE 1990 Summer National Meeting, San Diego, 1991, vol. 87, No. 282, pp. 44-52.
U.S. Appl. No. 13/869,736, filed Apr. 24, 2013, Richmond.
"Smart Engineering Behind Boost for Refinery", Press Release of Refining NZ, Jul. 30, 2014, p. 2.
NG, "Nonconventional Residuum Upgrading by Solvent Deasphalting and Fluid Catalytic Cracking", Energy & Fuels, 1997, vol. 11, No. 6, pp. 1127-1136.
Frazer et al., "Improving Commercial Hydrocracking Performance", "Asian Refining Technology Conference—Singapore", Apr. 1999, Publisher: The New Zealand Refining Company Limited, Published in: Whangarei, New Zealand, p. 39 pages.
Sudoh et al., "Upgrading of Heavy Oils by Asphaltenic Bottom Cracking", 185th ACS National Meeting, Seattle Meeting Mar. 20-25, 1983, Mar. 20, 1983, vol. 28, No. 3, pp. 600-620.
U.S. Appl. No. 14/481,461, filed Sep. 9, 2014, Wang et al.
Abstract of CN101418222B, published Sep. 12, 2012, 1 page, Ge et al.
Sprague, "How Solvent Selection Affects Extraction Performance", Presented at the 1986 National Petroleum Refiners Association Annual Meeting, Mar. 23-25, 1986, pp. 1-11.

* cited by examiner

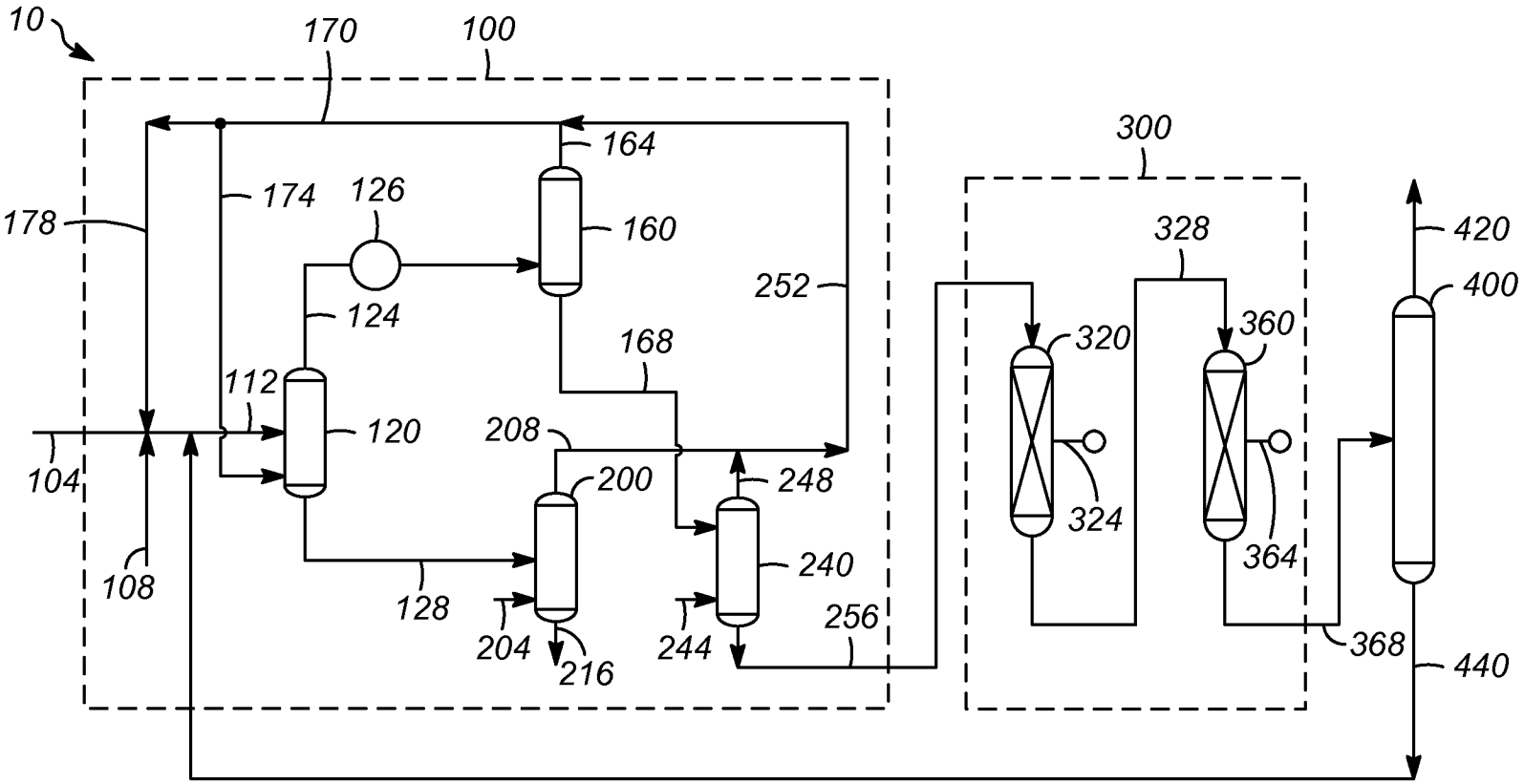
10
100
104
108
112
120
124
126
128
160
164
168
170
174
178
200
204
208
216
240
244
248
252
256
300
320
324
328
360
364
368
400
420
440

PROCESS FOR CONTROLLING OPERATIONS OF A RESIDUE PROCESS UNIT

FIELD OF THE INVENTION

This invention generally relates to a process for controlling operations of a residue process unit.

DESCRIPTION OF THE RELATED ART

As the price of crude rises, more refineries explore the possibility of upgrading the heavier fractions, such as a vacuum residue or resid, which may be purchased at a much lower cost. There are several available processes for upgrading heavier fractions, such as resid. In particular, a hydrocracking (HC) unit integrated with a solvent deasphalting (SDA) unit has been considered as a viable and cost effective option for resid upgrading to produce high-quality diesel fuel. In this process, the SDA unit extracts deasphalted oil (DAO) from the resid feed. The DAO may then enter the HC unit after combining with a vacuum gas oil (VGO) to produce high-value products as well as an unconverted oil (UCO). The UCO can be either partially recycled or used as feed for fluid catalytic cracking, ethylene or lube production. If recycled, heavy polynuclear aromatics (HPNAs) present in the UCO have to be managed as HPNAs can cause fouling in the exchangers and coking on the catalysts. Several designs can be used to manage HPNA rejection, such as a steam stripper, wiped film evaporator (WFE) and carbon-bed adsorption. However, such integration with the SDA unit can have an adverse impact on the HC unit operation since DAO would significantly increase formation of HPNAs in the UCO.

Particularly, SDA units can produce material boiling above the distillation cutpoint of vacuum gas oils. This material used as a feed may increase the tendency of forming HPNA molecules. If not managed, HPNAs can lead to fouling of reactor effluent exchangers and shorten catalyst life cycles in the HC unit. HPNAs become problematic in high conversion hydrocracking units, at conversion levels of 95% and higher. Thus, HPNAs can limit conversion.

HPNAs can be identified in very small quantities, typically in parts-per-million, via complicated analyses. Refineries typically do not have the capability to run these complicated analyses. Therefore traditional methods of monitoring and control have been used to analyze heptane insolubles and or pentane insolubles in the DAO products and adjust the vacuum column cutpoint and DAO yield to control the DAO quality. Thus, typically the catalyst lifecycle is reduced with an internal UCO recycle (RCO) while the conversion is lowered without the RCO. Balancing cycle length and conversion raises several operational challenges. As a consequence, there is a desire to integrate the HC unit and the SDA unit to allow the refinery to maximize the conversion and the cycle length in a flexible and effective way.

SUMMARY OF THE INVENTION

One exemplary embodiment can be a process for controlling operations of a residue process unit. The process may include analyzing an overhead stream from an extraction column in a solvent deasphalting zone to determine a density of the overhead stream, and adjusting conditions of the extraction column in response to the density determined for the overhead stream depending on the operating constraints of one or more downstream hydroprocessing zones.

Another exemplary embodiment may be a process for controlling operations of a residue process unit. The process can include analyzing an overhead stream from an extraction column in a solvent deasphalting zone to determine a density of the overhead stream, and adjusting conditions of the extraction column in response to the density determined for the overhead stream depending on the operating constraints of downstream hydroprocessing zones. Usually, the one or more downstream hydroprocessing zones includes at least one hydrotreating zone and at least one hydrocracking zone.

A further exemplary embodiment can be a process for controlling operations of a residue process unit. The process can include analyzing an overhead stream from an extraction column in a solvent deasphalting zone to determine a density of the overhead stream, adjusting conditions of the extraction column in response to the density determined for the overhead stream depending on the operating constraints of one or more downstream hydroprocessing zones, and recycling at least a portion of an unconverted oil from the at least one hydrocracking zone to the extraction column for enhancing extraction efficiency. Usually, the one or more downstream hydroprocessing zones includes at least one hydrotreating zone and at least one hydrocracking zone.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^{+}$ or $C3^{-}$, which is inclusive of the abbreviated one or more hydrocarbons. As an example, the abbreviation "$C3^{+}$" means one or more hydrocarbon molecules of three carbon atoms and/or more. A "stream" may also be or include substances, e.g., fluids or substances behaving as fluids, other than hydrocarbons, such as air, hydrogen, or catalyst.

As used herein, the term "zone" can refer to an area including one or more equipment items and/or one or more sub-zones. Equipment items can include one or more reactors or reactor vessels, separators, strippers, extraction columns, fractionation columns, heaters, exchangers, pipes, pumps, compressors, and controllers. Additionally, an equipment item, such as a reactor, dryer, or vessel, can further include one or more zones or sub-zones.

As used herein, the term "vacuum gas oil" may be abbreviated as "VGO" and can mean a hydrocarbon material boiling in the range of about 343-about 565° C., and can include one or more C18-C50 hydrocarbons. The VGO may be prepared by vacuum fractionation of an atmospheric residue. Such a fraction is generally low in coke precursors and heavy metal contamination, which can serve to contaminate catalyst. Often, a VGO has a boiling range with an initial boiling point of about 340° C., a T5 of about 340-about 350° C., a T95 of about 555-about 570° C., and an end point of about 570° C.

As used herein, the term "atmospheric residue" may be abbreviated as "AR" and can mean a hydrocarbon material obtained from the bottoms of an atmospheric crude distillation column. Generally, atmospheric residue is high in coke precursors and metal contamination. Often, an AR has a boiling range with an initial boiling point of about 340° C., a T5 of about 340-about 360° C., and a T95 of about 700-about 900° C.

As used herein, the term "vacuum residue" may be abbreviated as "VR" and can mean a hydrocarbon material boiling no less than about 530° C., and can include one or more $C40^+$ hydrocarbons.

As used herein, the term "unconverted oil" may be abbreviated herein as "UCO" and can refer to a high boiling hydrocarbon fraction, separated from the hydrocracker effluent, that can boil at temperatures above those representative of diesel boiling range hydrocarbons. Generally, the unconverted oil has a T1 of at least about 250° C., typically at least about 288° C., and often at least about 316° C. In many cases this higher boiling fraction will represent a minor amount (e.g., no more than about 45%, by volume) of the hydrocracker effluent, due to the significant extent of cracking reactions occurring in the hydrocracking reactor or reaction zone to provide lower molecular weight products. The distillation end point of the unconverted oil is generally close to that of the feedstock. When VGO is used as a major component of, or as the entire, fresh feed component, the unconverted oil typically has a T99 of no more than about 593° C. (e.g., in the range of about 510-about 593° C.), and often at most about 566° C. When DAO is used as a component of, or as the entire, fresh feed component, the unconverted oil can have a distillation end point of at least about 700° C. Recycled UCO within a residue process unit may be abbreviated as "RCO".

As used herein, the term "true boiling point" may be abbreviated "TBP" and can mean a test method for determining the boiling point of a material that corresponds to ASTM D-2892-13 for the production of a liquefied gas, distillate fractions, and residuum of standardized quality on which analytical data can be obtained. The determination of yields of the above fractions by both mass and volume from a graph of temperature versus mass percent distilled is produced using fifteen theoretical plates in a column with about a 5:1 feed:reflux ratio. Such distillation points may be characterized by the nomenclature T5, T50, T85, and the like. Generally, the designation means the amount of material, by mass, that has distilled from a sample at a given temperature. As an example, a "T5 of 200° C." means that 5%, by mass, of a sample has distilled at 200° C.

As used herein, the term "diesel cut point" can be about 343-about 399° C. using the TBP distillation method.

As used herein, the term "diesel boiling range" can mean hydrocarbons boiling in the range of at least about 132° C. or the diesel cut point using the TBP distillation method.

As used herein, the term "diesel conversion" can mean conversion of feed that boils above the diesel cut point to material that boils at or below the diesel cut point in the diesel boiling range.

As used herein, the term "heavy polynuclear aromatics" may be abbreviated "HPNA" and can characterize compounds having seven or more "benzene rings" typically produced in a hydrocracking reaction zone. Such heavy polynuclear aromatics may also be referred to as polynuclear aromatics.

As used herein, the term "coronene" can mean a polycyclic aromatic hydrocarbon including six peri-fused benzene rings and have the chemical formula $C_{24}H_{12}$.

As used herein, the term "initial boiling point" can mean the temperature of a liquid at which its vapor pressure is equal to the standard pressure (101.3 KPa), i.e., when the first gas bubble appears.

As used herein, the term "American Petroleum Institute gravity" may be abbreviated "API gravity" and can be a measure of how heavy or light a petroleum liquid is compared to water.

As used herein, the term "degrees Celsius" may be abbreviated "° C.", "hour" may be abbreviated "hr", "meter cubed" may be abbreviated "$m^3$", "mega Pascal" may be abbreviated "MPa", and the term "kilo Pascal" may be abbreviated "KPa".

As depicted, process flow lines in the FIGURES can be referred to interchangeably as, e.g., lines, pipes, feeds, parts, portions, remainders, effluents, products, or streams.

BRIEF DESCRIPTION OF THE DRAWING

The FIGURE is a schematic depiction of an exemplary unit.

DETAILED DESCRIPTION

A residue process unit 10 can include a solvent deasphalting zone 100, one or more downstream hydroprocessing (HP) zones 300, and a HP fractionation zone 400. These zones 100, 300, and 400 can include various equipment, such as one or more extraction columns, separators, strippers, reactors, and fractionation columns Exemplary equipment is disclosed in, e.g., US 2011/0139681 and US 2010/0326883.

Generally, the solvent deasphalting zone 100 includes an extraction column 120, a separator 160, a first stripper 200, and a second stripper 240. A feed stream 104 can include any heavy hydrocarbon fraction, such as a vacuum gas oil, a vacuum residue (VR), or an atmospheric residue (AR). The feed stream 104 may include other heavy hydrocarbon feedstocks, such as heavy bottoms from crude oil, pitch, heavy bitumen crude oil, shale oil, tar sand extract, deasphalted residue, heavy coker gas oils, products from coal liquefaction, and vacuum reduced crudes. Typically, pitch includes a vacuum gas oil, VR, and/or AR. Fresh hydrocarbon feedstocks also include mixtures of the above hydrocarbons and the foregoing list is not comprehensive.

Usually, the feed stream 104 can include a pitch having an initial boiling point of at least about 340° C. The feed stream 104 can be combined with a make-up solvent stream 108 and a second stream 178, as hereinafter described, including recycled solvent before entering into the first extraction column 120 as a feed in the line 112. Additional solvent, for example, recycled solvent, may be added to a lower end of the extraction column 120 via a line 174. The light paraffinic solvent, typically propane, butane, pentane, hexane, heptane or mixtures thereof can dissolve a portion of the feed 112 in the solvent. An exemplary solvent can be propane, butane, or pentane. The feed 112 solubilized in the solvent may rise to an overhead of the extraction column 120. The determining quality for solvency of a light hydrocarbon solvent can be its density, so equivalent solvents to a particular solvent can have an equivalent density. For example, in an embodiment, heptane is the most dense solvent that can be used without lifting high concentrations of vanadium in the DAO. Solvents with lower densities than heptane would also be suitable for lifting lower concentrations of vanadium in the DAO. Often, the solvent solubilizes the paraffinic and less polar aromatic compounds in the pitch feed. One suitable solvent is N-pentane. Usually, the heavier portions of the feed 112 are insoluble and settle down as an asphaltene or pitch stream 128 from a pitch outlet in the line 128 and a first DAO stream is extracted in an extract emitted from a DAO outlet in a line 124. Typically, the DAO stream in the line 124 has the dissolved portion of the pitch.

Often, the extraction column 120 operates at about 90-about 210° C., and about 3.0-about 6.0 MPa. The temperature and pressure of the extraction column 120 are typically below the critical point of the solvent but can be above or below the critical point as long as the density is well controlled. Generally, the DAO stream in the line 124 has a lower concentration of metals than in the feed 112. Conditions of the extraction column 120 can be adjusted in response to the density determined for the DAO stream in the line 124 depending on the operating constraints of one or more downstream hydroprocessing zones 300, as hereinafter described.

Usually, about 20-about 70%, by weight, of the feed stream 104 is removed, and this removal portion contains the lowest molecular weight and the most paraffinic portion of the VR and is most suitable for secondary upgrading such as in catalytic hydroprocessing. Typically, the first DAO stream is heated to supercritical temperature for the solvent by indirect heat exchange with a heated solvent in a solvent recycle line 208 and optionally an additional fired heater or heat exchanger. The supercritically heated solvent can separate from the DAO in the separator 160, which may be a DAO separator column that typically is in downstream communication with an upper part of the extraction column 120. Typically, a solvent recycle stream 164 exits the separator 160 in the solvent recycle line 170. The solvent recycle stream 164 can pass an online analyzer 126, as hereinafter described, and be condensed by indirect heat exchange in a heat exchanger. Usually, the separator 160 operates at about 170-about 290° C., and about 3.0-about 6.0 MPa.

Often, the extractor bottoms stream in the line 128 contains a greater concentration of metals than the feed 112. The bottoms stream in the line 128 can be heated in a fired heater or by other means of heat exchange and stripped in the first stripper 200 to yield a solvent-lean pitch or rejection stream in a bottoms line 216 and a first solvent recovery stream in the line 208. Steam from the line 204 may be used as stripping fluid in the first stripper 200. The first stripper 200 can be in downstream communication with a pitch outlet from the extraction column 120 for separating solvent from pitch. Often, the bottoms or asphaltene stream 216 contains a large portion of the contaminants such as Conradson carbon residue and metals and has a high density of about 5-about −10 API gravity, and commonly of about 0-about 10 API gravity. The rejection stream 216 can also include HPNAs, and HPNA precursors such as coronenes. This rejection stream 216 may also have high concentrations of HPNAs. Usually, the first stripper 200 operates at about 200-about 260° C., and about 300-about 1,100 KPa.

A solvent-lean DAO stream 168 may exit the separator 160 and enter the second stripper 240, such as a DAO stripper column, in downstream communication with a bottom of the separator 160. Usually, the second stripper 240 further separates a second solvent recovery stream 248 from the DAO stream 168 by stripping DAO from the entrained solvent at low pressure. Steam from the line 244 may be used as stripping fluid in the second stripper 240. Typically, the second stripper 240 operates at about 140-about 260° C. and about 340-about 1,100 KPa. Usually, the second solvent recovery stream leaves in the line 248 and joins the first solvent recovery stream in a line 208 before being condensed by a cooler and optionally stored in a solvent reservoir before recycling. Recovered solvent may be recycled from the solvent reservoir as necessary to supplement the solvent in the line 164 to be mixed with the feed stream 104. Usually essentially solvent-free DAO, which is at least a portion of the DAO emitted from a DAO outlet, is provided in the line 256.

The DAO, which typically has the dissolved portion of the pitch, in the line 256 may optionally be blended with other heavy hydrocarbons, such as a heavy vacuum gas oil (HVGO), and be provided to the one or more downstream hydroprocessing zones 300, which in this exemplary embodiment includes a hydrotreating (HT) zone 320 and a hydrocracking (HC) zone 360. In other embodiments, the one or more downstream hydroprocessing zones 300 may include other hydroprocessing equipment, such as a slurry hydrocracking reactor. Such a slurry hydrocracking reactor is disclosed in, e.g., US 2010/0326883.

The essentially solvent-free DAO can optionally be combined with another hydrocarbon feed, which may include at least some of the hydrocarbon material described above for the feed stream 104, such as a VGO, and sent to the one or more downstream hydroprocessing zones 300. Typically, the essentially solvent-free DAO can be provided first to the HT zone 320, which may include a catalytic hydrotreating reactor with one or more fixed beds of the same or different catalysts.

The HT zone 320 can include a hydrotreating reactor, as well as other vessels, such as separators, adsorbers, and strippers. The hydrotreating reactor can contain a hydrotreating catalyst and be operated at hydrotreating conditions sufficient to reduce the level of metal compounds, sulfur and nitrogen compounds and saturate hydrocarbons. The hydrotreating reactor is typically operated at a temperature of about 204-about 482° C., and a pressure of about 3.5-about 20.8 MPa.

Hydrotreating may utilize a hydrogen-containing treat gas in the presence of suitable catalysts in a fixed bed. The catalysts may be primarily active for the removal of heteroatoms, such as sulfur, nitrogen and metals and for some hydrogenation of aromatic compounds. Suitable hydrotreating catalysts can be any known conventional hydrogenation catalysts and include those that are comprised of at least one metal of groups 8-10, preferably iron, cobalt and nickel, more preferably cobalt and/or nickel, and at least one group 6 metal, preferably molybdenum and tungsten, on a high surface area support material, preferably alumina. In some exemplary embodiments, more than one type of hydrotreating catalyst may be used in the same hydrotreating reactor or vessel. The metal of groups 8-10 is typically present in an amount ranging from about 2-about 20%, by weight, preferably about 4-about 12%, by weight, based on the total catalyst weight. The group 6 metal is typically present in an amount ranging from about 1-about 25%, by weight, typically about 2-about 25%, by weight, based on the total catalyst weight. One or more thermocouples 324 or other devices may be used to monitor temperatures or other parameters, for providing controls to be implemented with the solvent deasphalting zone 100, as hereinafter described. In this exemplary embodiment, the essentially solvent-free, DAO in the line 256 can be provided to the HT zone 320. An effluent 328 from the HT zone 320 can be provided to the HC zone 360.

In one exemplary embodiment, the catalytic hydrocracking catalysts utilize amorphous bases or low-level zeolite bases combined with one or more metal hydrogenating components from groups 6 and 8-10 of the periodic table. In another embodiment, the catalytic hydrocracking reactor contains a catalyst having any suitable crystalline zeolite cracking base upon which is deposited a minor portion of a metal hydrogenating component from groups 8-10 of the periodic table. Additional hydrogenating components may be selected from group 6 for incorporation with the zeolite base. The zeolite cracking bases are sometimes referred to as molecular sieves and are usually composed of silica, alumina and one or more exchangeable cations, such as sodium, magnesium, calcium and rarer metals. They are further characterized by crystal pores of relatively uniform diameter of about 4-about 14 Angstroms. It is preferable to employ zeolites having a relatively high silica to alumina mole ratio of about 3:1-about 12:1. Suitable zeolites found in nature include, for example, mordenite and faujasite. Suitable synthetic zeolites include, for example, the B, X, Y and L crystal types, for example, synthetic faujasite and mordenite. The preferred zeolites are those having crystal pore diameters of about 8-about 12 Angstroms, where the silica to alumina mole ratio is about 4:1-about 6:1. Usually, the zeolites, which are preferably used for the base of catalytic hydrocracking catalysts, are readily commercially available.

The active metals employed in the preferred catalytic hydrocracking catalysts as hydrogenation components are at least one of groups 8-10 of the periodic table, e.g., iron, cobalt, nickel, ruthenium, rhodium, palladium, osmium, iridium and platinum. In addition to these metals, other promoters may also be employed in conjunction therewith, including one or more metals of group 6, e.g. molybdenum and tungsten. The amount of hydrogenating metal in the catalyst can vary within wide ranges. Broadly speaking, any amount between about 0.05-about 30%, by weight, based on the weight of the catalyst may be used. In the case of the noble metals, it is normally preferred to use about 0.05-about 2%, by weight, based on the weight of the catalyst. The preferred method for incorporating the hydrogenating metal is to contact the base material with an aqueous solution of a suitable compound of the desired metal where the metal is present in a cationic form. Following the addition of the selected hydrogenating metal or metals, the resulting catalyst powder is then filtered, dried, pelleted with added lubricants, binders or the like if desired, and calcined in air at a temperature of, e.g., about 371-about 648° C. in order to activate the catalyst and decompose ammonium ions. Alternatively the base may first be pelleted followed by the addition of the hydrogenating component and activation by calcining. The foregoing catalysts may be employed in undiluted form or the powdered zeolite catalyst may be mixed and copelleted with other relatively less active catalysts, diluents or binders, such as alumina, silica gel, silica-alumina cogels, activated clays and the like, in proportions ranging from about 5-about 90%, by weight, based on the weight of the catalyst. These diluents may be employed as such or they may contain a minor proportion of an added hydrogenated metal, such as at least one metal of group 6 and/or groups 8-10 of the periodic table.

The catalytic hydrocracking is conducted in the presence of hydrogen and preferably at catalytic hydrocracking reactor conditions, which may include a temperature of about 204-about 482° C., and a pressure of about 3.5-about 20.8 MPa. In addition, catalytic hydrocracking conditions may include a liquid hourly space velocity of about 0.1-about 30 $hr^{-1}$, and a hydrogen circulation rate of about 337-about 4,200 normal $m^3/m^3$. The catalytic hydrocracking is conducted over a fixed catalyst bed in down flow. One or more thermocouples 364 or other devices may be used to monitor temperatures or other parameters, for facilitating controls to be implemented with the solvent deasphalting zone 100, as hereinafter described.

An HC effluent 368 from the HC zone 360 can be sent to the HPF zone 400. The HPF zone 400 may include one or several vessels, such as a stripper vessel and an atmospheric column but in an aspect may be just a single column. An inert gas such as medium pressure steam may be fed near the bottom of the fractionation column. The fractionation column produces an overhead product 420, which may include one or more of naphtha, kerosene, and diesel boiling range hydrocarbons. The fractionation column can operate at a cut point to provide one or more hydrocarbons having an initial boiling point of at least about 343° C., or even about 379° C., in the stream 440. The stream 440 can be at least a portion or all of an UCO stream from the HPF zone 400.

Optionally, the stream 440 can be further fractionated. Such fractionation can produce a light UCO stream and a heavy UCO stream, and depending on operations, can be provided to the extraction column 120 to enhance extraction. The heavy UCO stream can be sent to the extraction column 120 and the light UCO stream can be sent downstream of the extraction column 120 and upstream of the HT zone 320. The fractionation column can operate at a cut point to provide one or more hydrocarbons having an initial boiling point of at least about 379° C., about 450° C., about 505° C., or even about 530° C., and use steam stripping. The stream sent downstream of the extraction column 120 can be at least about 90%, or even about 100%, by weight, of the light UCO stream, although the split can be adjusted based on operational conditions and more material may be sent to the extraction column 120.

Establishing a recycle of UCO to an SDA zone 100 can improve UCO quality by reducing coronenes, such as up to about 7%, by weight, of a coronene ($C_{24}H_{12}$) in the UCO, when running at 98% conversion with 2.5%, by weight, recycle to the SDA zone 100.

The DAO yield can be increased and the corresponding quality of the DAO decreased. However, recycling not only improves DAO quality, but allows obtaining higher yields as well. Using the online density analyzer permits advantageously obtaining these results in real time.

Operational monitoring of DAO quality can be done by measuring the density of the solvent phase of the extractor overhead DAO stream 124. In one exemplary embodiment, the quality of DAO could be further improved by decreasing the yield of DAO. This improvement can be accomplished by operating with the SDA extractor overhead phase stream 124 density at the same density as it was running prior to initiating a UCO recycle.

Density can be monitored by using an online density analyzer. Exemplary meters include a coriolis flow meter for determining density. Alternatively, a densitometer sold under the trade designation MICROMOTION 7835 by Emerson of St. Louis, Mo. can be used.

For a given unit, developing a reference correlation of coronene content in the UCO as a function of recycle rate and SDA extractor overhead density may optimize operations. Although not wanting to be bound by theory, typically every solvent has a temperature point called the lower critical solution temperature. Usually, as this lower critical solution temperature is approached, DAO yield is increasing. However, once the temperature falls below that lower limit, the DAO yield can begin to decrease rapidly. It is thought that the extraction column may fail to separate the two phases because the solvent is just too cold relative to the feed stream, and thus, the feed stream viscosity becomes too high. So, lower temperature can increase density and yield, up to a certain point. Often, the temperature selected is dependent on the type of solvent.

Depending on the quality of the hydroprocessing zone 300 product, the temperature of the extraction column 120 can be adjusted to alter the density of the stream 124. A lower temperature, e.g., no more than about 110° C., for a solvent such as butane in the extraction column 120 can translate into a higher density and a lower quality overhead stream, but a higher yield. Generally, the quality decreases with the inclusion of heavier compounds not suitable for a diesel cut, including impurities such as coronenes and HPNAs. A higher temperature, e.g., at least about 140° C., for a solvent such as butane in the extraction column 120 may translate into a lower density and a higher quality overhead stream, but a lower yield. As an example, if new catalyst is installed in the downstream hydroprocessing zone 300, a lower quality product may be obtained from the SDA zone 100 with a higher yield. Generally, the temperature selected is dependent on the type of solvent used. Usually, the less dense solvents favor extraction of lighter oil components, while heavier density solvents favor extraction of heavier oil components. As the catalyst ages in the downstream hydroprocessing zone 300, the temperature of the extraction column 120 can be raised to lower density and improve quality with the downside of reduced yields. In some control schemes, such a process can be automated. If the UCO recycle is split, this split can also be manipulated by sending lighter UCO to the extraction column 120 to improve the quality of the stream 124.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for controlling operations of a residue process unit, comprising:

A) analyzing an overhead stream from an extraction column in a solvent deasphalting zone to determine a density of the overhead stream; and B) adjusting conditions of the extraction column in response to the density determined for the overhead stream depending on the operating constraints of one or more downstream hydroprocessing zones.

2. The process according to claim 1, wherein adjusting the conditions comprises lowering a temperature in the extraction column.

3. The process according to claim 2, wherein lowering the temperature in the extraction column increases extraction yield and decreases overhead stream quality.

4. The process according to claim 3, further comprising providing a solvent comprising butane to the extraction column wherein the temperature in the extraction column is lowered to no more than about 110° C.

5. The process according to claim 3, further comprising providing a solvent comprising butane to the extraction column and raising a temperature to at least about 140° C. in the extraction column to decrease extraction yield and increase overhead stream quality.

6. The process according to claim 1, wherein adjusting the conditions comprises raising a temperature in the extraction column.

7. The process according to claim 6, wherein raising the temperature in the extraction column decreases extraction yield and increases overhead stream quality.

8. The process according to claim 7, further comprising providing a solvent comprising butane to the extraction column wherein the temperature in the extraction column is at least about 140° C.

9. The process according to claim 1, wherein the conditions of the operating column comprise a temperature of about 70-about 210° C. and a pressure of about 3-about 6 MPa.

10. The process according to claim 1, wherein the one or more downstream hydroprocessing zones comprises a hydrotreating zone and a hydrocracking zone.

11. The process according to claim 1, further comprising providing an unconverted oil to the solvent deasphalting zone.

12. The process according to claim 11, wherein at least a portion of the unconverted oil is provided from a hydrocracking zone.

13. The process according to claim 1, wherein the analyzing is conducted using an online density analyzer.

14. A process for controlling operations of a residue process unit, comprising:

A) analyzing an overhead stream from an extraction column in a solvent deasphalting zone to determine a density of the overhead stream; and B) adjusting conditions of the extraction column in response to the density determined for the overhead stream depending on the operating constraints of downstream hydroprocessing zones wherein the one or more downstream hydroprocessing zones comprises at least one hydrotreating zone and at least one hydrocracking zone.

15. The process according to claim 14, wherein the conditions of the extraction column comprise a temperature of about 70-about 210° C. and a pressure of about 3-about 6 MPa.

16. The process according to claim 14, further comprising providing an unconverted oil from a hydrocracking zone to the solvent deasphalting zone.

17. The process according to claim 14, wherein the analyzing is conducted using an online density analyzer.

18. The process according to claim 14, further comprising providing a solvent comprising butane to the extraction column and lowering a temperature to no more than about 110° C. in the extraction column to increase extraction yield and decrease overhead stream quality.

19. A process for controlling operations of a residue process unit, comprising:

A) analyzing an overhead stream from an extraction column in a solvent deasphalting zone to determine a density of the overhead stream;

B) adjusting conditions of the extraction column in response to the density determined for the overhead stream depending on the operating constraints of one or more downstream hydroprocessing zones wherein the downstream hydroprocessing zones comprise at least one hydrotreating zone and at least one hydrocracking zone; and C) recycling at least a portion of an unconverted oil from the at least one hydrocracking zone to the extraction column for enhancing extraction efficiency.

20. The process according to claim 19, wherein the conditions of the operating column comprise a temperature of about 70-about 210° C. and a pressure of about 3-about 6 MPa.

* * * * *